US006752711B1

(12) United States Patent
Yeung

(10) Patent No.: US 6,752,711 B1
(45) Date of Patent: Jun. 22, 2004

(54) MOTOR HOUSING FOR RANGE HOOD

(76) Inventor: Peter Yeung, 4446 Frances Street, Burnaby, British Columbia (CA), V5C 2R4

( * ) Notice: Subject to any disclaimer, the term of this patent is extended or adjusted under 35 U.S.C. 154(b) by 0 days.

(21) Appl. No.: 10/619,430

(22) Filed: Jul. 16, 2003

(51) Int. Cl.[7] ..... B08B 15/02
(52) U.S. Cl. ..... 454/56; 454/49
(58) Field of Search ..... 454/49, 56, 57, 454/58, 60, 66, 67; 126/299 F, 299 R, 299 D

(56) References Cited

U.S. PATENT DOCUMENTS 5,027,790 A * 7/1991 Chern ..... 126/299 R
5,232,152 A * 8/1993 Tsang ..... 236/44 A
5,515,840 A * 5/1996 Jang ..... 126/299 R
5,803,072 A * 9/1998 Strand ..... 126/299 R
6,216,686 B1 * 4/2001 Chiu ..... 126/299 R

* cited by examiner

*Primary Examiner*—Derek S. Boles
(74) *Attorney, Agent, or Firm*—Paul Smith Intellectual Property Law; Paul Smith

(57) ABSTRACT

A range hood with a motor housing having upper and lower sections joined together along their respective side edges. Cooperating projections with a gap therebetween extend from the side edge of one section of the motor housing. The side edge of the other section of the motor housing is adapted to be Inserted in the gap to be frictionally retained therein. Protrusions ensure proper joining of the upper and lower sections. Additional restraint in the form of a reinforcing assembly comprising a reinforcing strap plus fasteners ensures the upper and lower sections stay properly joined. The motor housing may be made of metal or plastic.

12 Claims, 8 Drawing Sheets

MOTOR HOUSING FOR RANGE HOOD

FIELD OF THE INVENTION

The present invention relates to range hood motor housings, and more particularity to an improved motor housing design.

BACKGROUND OF THE INVENTION

Range hoods are used above cooking surfaces to remove grease, common odors and hazardous gases created during the cooking process. Typically, range hoods for domestic use have a pair of motors horizontally installed in a motor housing within the hood body. Each motor drives a fan. The fans draw air from the cooking area below and force it through the motor housing to ventilation piping.

The motor housing defines an enclosure and is mountable within a further enclosure formed by the range hood body. The side walls of the motor housing are substantially vertical and when viewed from above or below appear to generally define a figure-eight pattern. The interior of the housing is separated into two substantially similar, separate chambers. Each chamber has an air inlet and a ventilation hole.

The heated air drawn from the cooking area generally contains some vaporized grease. As the air is forced through the motor housing, some of the grease condenses and is deposited on the inside surfaces of the motor housing. The motor housing is generally shaped to funnel the condensed grease to the bottom of the housing, eventually draining to an external grease cup. However, because the grease is airborne it is therefore important to ensure that the housing is completely sealed, to prevent the grease from escaping into the main range hood body. It is also desirable to be able to access the motor housing interior in order to clean it.

U.S. Pat. No. 5,537,988 shows a typical motor housing constructed using a single piece of metal, suspended from the underside of the range hood body and welded in place. Because the motor housing cannot be removed or disassembled, a person must clean the motor housing by reaching up through the fan opening. The person is working "blind" inside the housing, which makes it difficult to thoroughly clean. Also, a non-metallic motor housing cannot be welded in place on the range hood body. Use of a plastic motor housing, for example, would result in an imperfect seal between the motor housing and range hood thereby allowing grease to escape into the main range hood body.

Another type of motor housing is made from an upper section and a lower section, joined by welding the sides together. The entire housing and the motors are then connected to the range hood body. This construction is difficult and expensive, as it requires careful folding of the metal and expensive welding. Again, the housing cannot be disassembled and is therefore difficult to clean. Furthermore, this form of connection cannot be used for a plastic motor housing as folding and welding of plastic is not an option.

It is therefore an object of the present invention to provide a range hood having a motor housing that may be snugly sealed, preventing condensed grease from escaping into the main range hood body.

It is a further object of the present invention to provide a motor housing for a range hood that may be made of metallic or non-metallic material.

It is a further object of the present invention to provide a motor housing for a range hood that can be easily disassembled and reassembled, to facilitate thorough cleaning and access to the motor housing interior.

Not all aspects of the invention necessarily address each of these objects. Other objects of the invention will be apparent from the description that follows.

SUMMARY OF THE INVENTION

According to the present invention there is provided a motor housing for a range hood. An upper section of the motor housing is snugly joined around its outer edge to a lower section of the motor housing, thereby forming the perimeter side surfaces of the motor housing. The upper and lower sections are snugly joined by inserting the top edge of the lower section into a gap in the lower rim of the top section.

In one aspect the invention comprises a motor housing for mounting within a range hood body used to exhaust gases from above a cooking surface. The motor housing comprises an upper section having a top surface and a first side perimeter surface extending away from the top surface. A lower section having a bottom surface and a second side perimeter surface extends away from the bottom surface. The edge of one of the first or second side perimeter surfaces has cooperating projections with a gap therebetween. The edge of the other of the first or second side perimeter surfaces is adapted to be inserted in the gap between the cooperating projections to be frictionally retained therein.

In another aspect, the first side perimeter surface has the cooperating projections and the edge of the second side perimeter surface is adapted to be inserted in the gap between the cooperating projections to be frictionally retained therein.

In yet a further aspect, the motor housing further comprises a plurality of protrusions on the second side perimeter surface. The protrusions may be spaced from the edge of the second side perimeter surface a maximum distance equal to the depth of the gap between the cooperating projections.

In yet a further aspect, the motor housing further comprises a reinforcing assembly. The reinforcing assembly may take the form of a reinforcing strap and a fastening means. The fastening means comprise a pair of aligned fasteners, one on each section of the motor housing, to which the reinforcing strap may be connected. The fasteners could take the form of a pin and cotter pin, a self-locking pin such as a snap-fit pin, or a bolt and nut. A plurality of reinforcing assemblies may be spaced about the perimeter side surface of the motor housing.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

These and other features of the invention will become more apparent from the following description in which reference is made to the appended drawings and wherein.

DETAILED DESCRIPTION OF THE PREFERRED EMBODIMENT

Figure 1A:
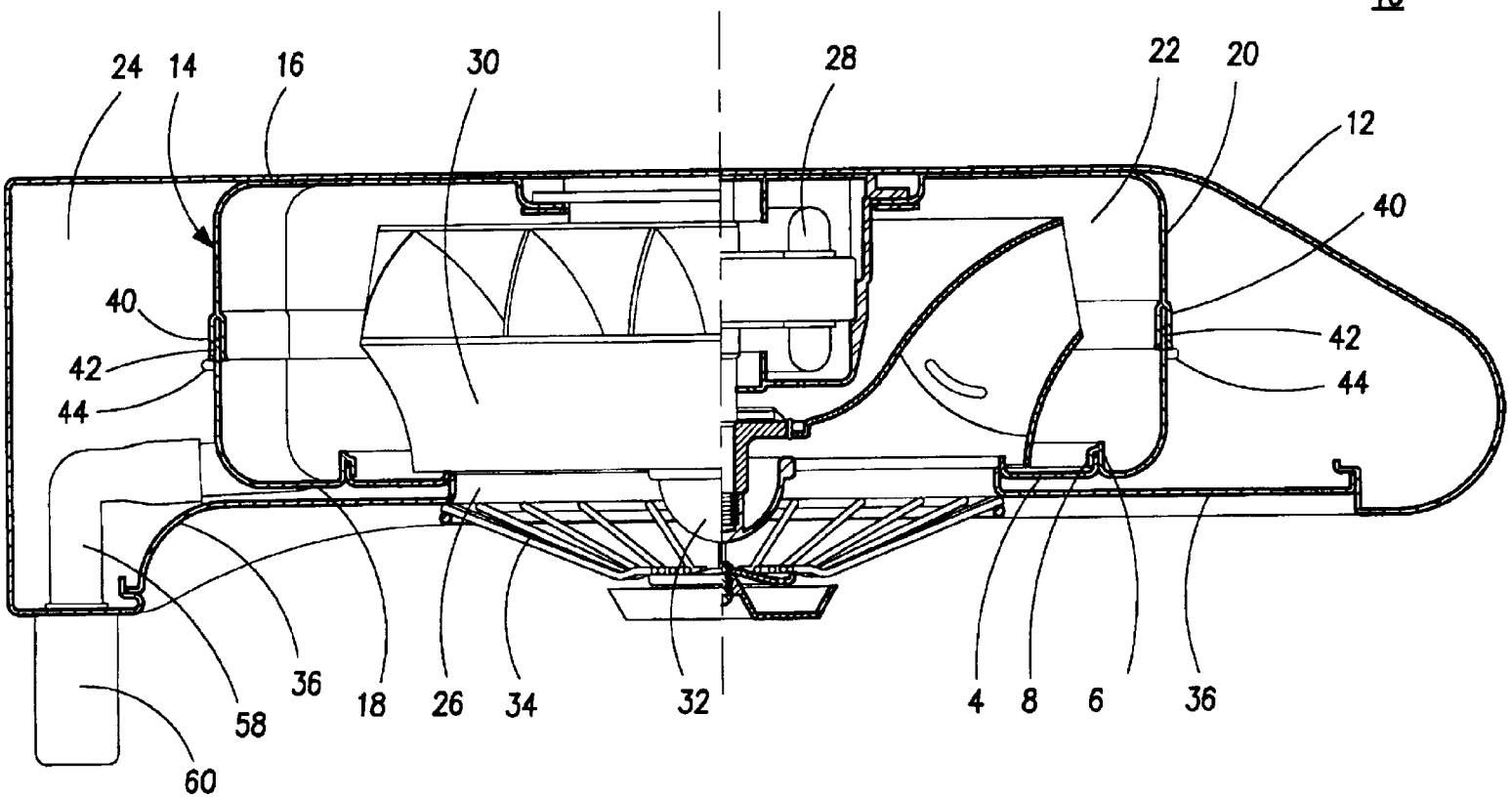
FIG. 1A is a side sectional view of a kitchen range hood, including the preferred embodiment of a motor housing according to the invention, with the right hand portion of the figure providing a deeper sectional view than the left hand portion of the figure.
Figure 1B:
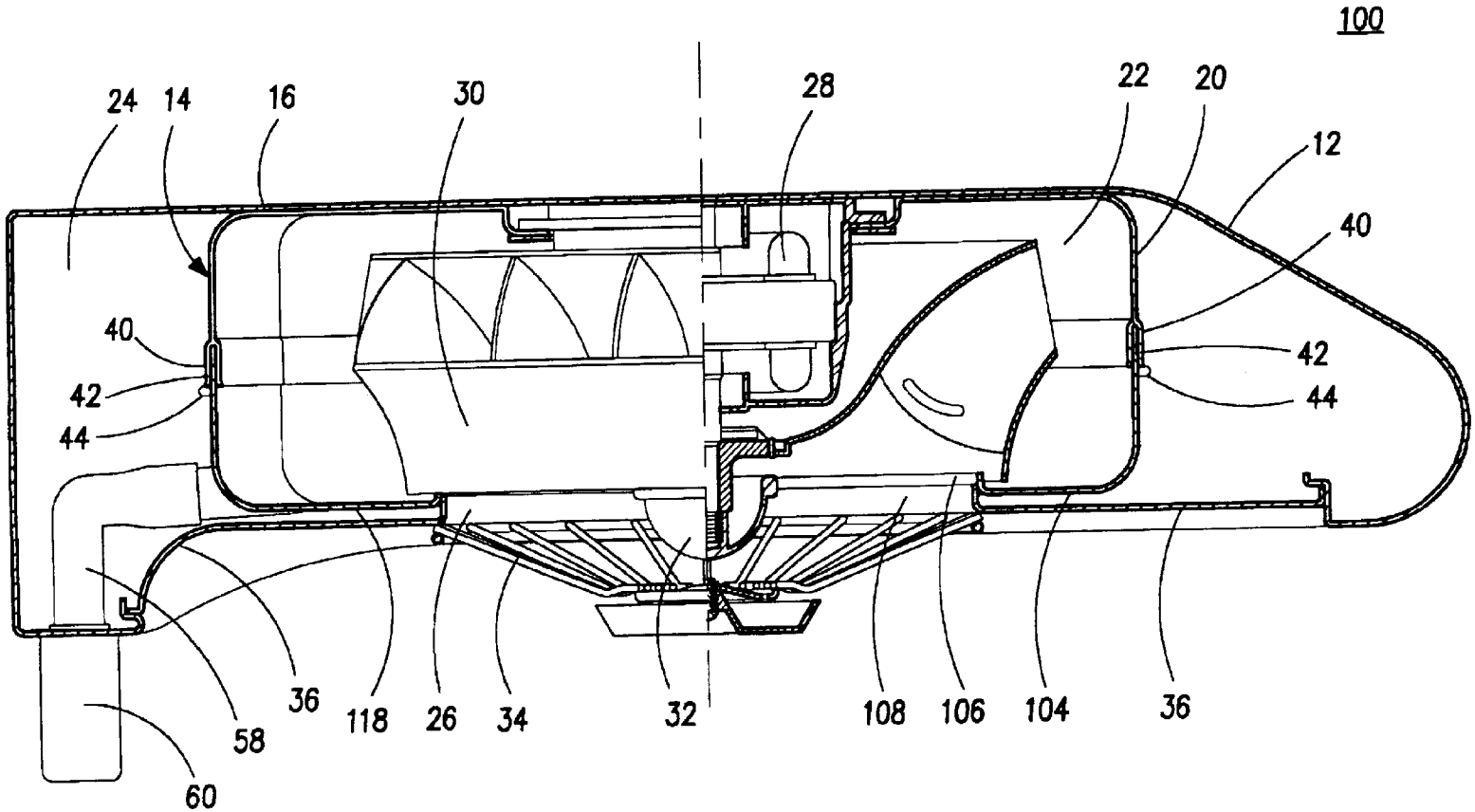
FIG. 1B is a side section view of a kitchen range hood, including an alternative embodiment of a motor housing according to the invention, with the right hand portion of the figure providing a deeper sectional view than the left hand portion of the figure.
Figure 2:
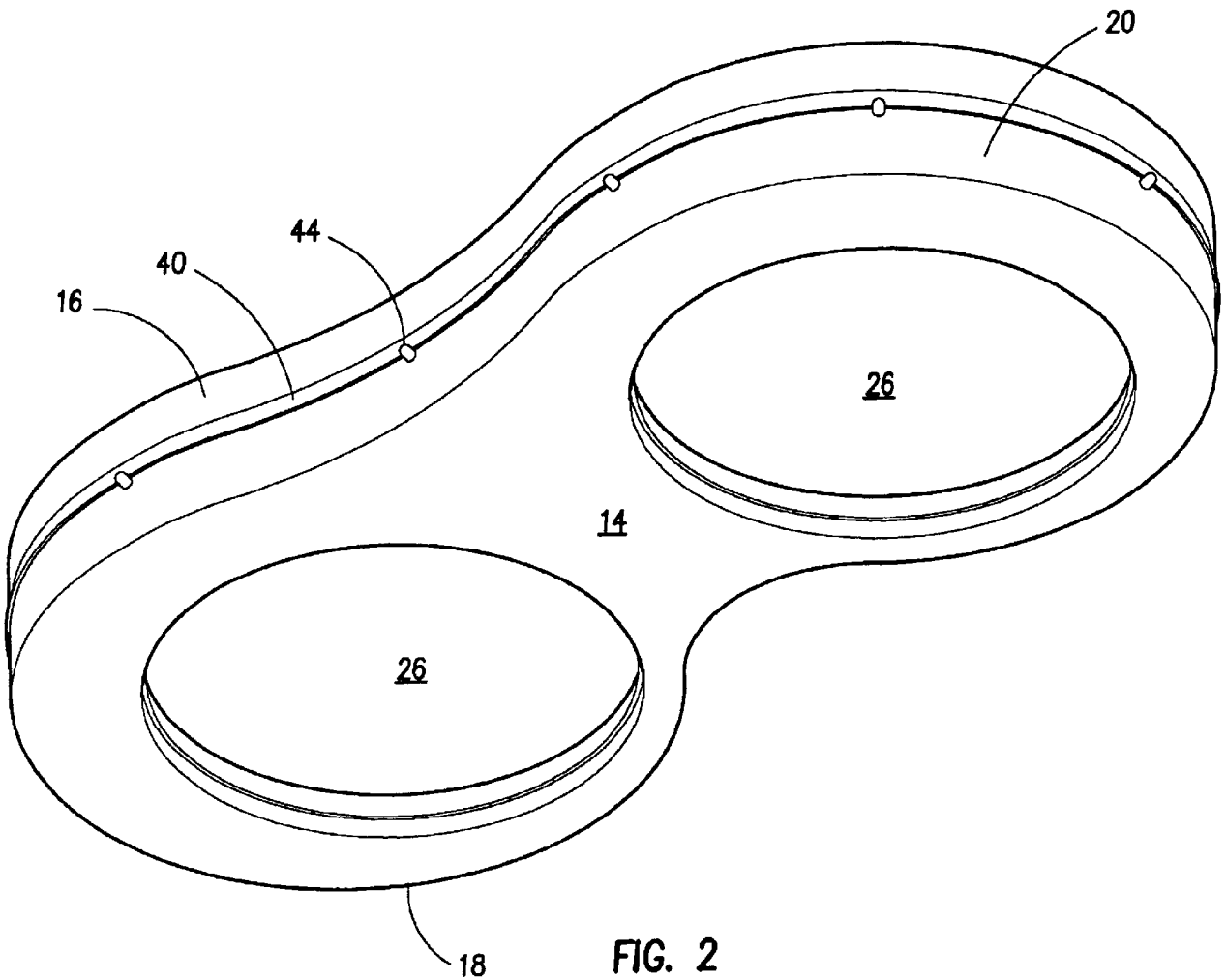
FIG. 2 is a bottom perspective view of the preferred embodiment of the motor housing.

FIGS. 1A and 2 show a range hood 10 comprising a range hood body 12 in which a motor housing 42 according to the preferred embodiment of the invention is mounted.

Range hood 10 is designed to be mounted above a home cooking surface, such as a four-burner stove, in order to facilitate the removal of grease laden vapors and the like generated while cooking. The motor housing 14 has top section 16, bottom section 18 and perimeter side surfaces 20 which define an enclosure 22 and is mountable within a further enclosure 24 formed by the range hood body 12. The motor housing 14 may be made of metal or a non-metallic material such as plastic. The interior of the housing 14 may be coated with a non-stick material so as to facilitate grease removal.

The assembled housing 14 comprises two chambers (only one of which is visible in FIG. 1A), each accessible through an air inlet 26 in the underside of the housing 14. A motor 28 is fitted in each chamber of the housing 14 and is attached to the inside of the upper surface of the range hood body 12. A fan 30 is secured to each of the motors 28 by fan caps 32. Fan grill 34 connected to lower panel 36 prevents foreign objects from being inserted through air inlet 26 and into the fan 30. Lower panel 36 is releasably connectable to the rest of range hood body 12. When the motors 28 are In operation, each fan 30 rotates and acts to draw grease-laden air through air inlet 26 and into the motor housing 14 where it is forced out the ventilation hole (not shown).

Figure 3B:
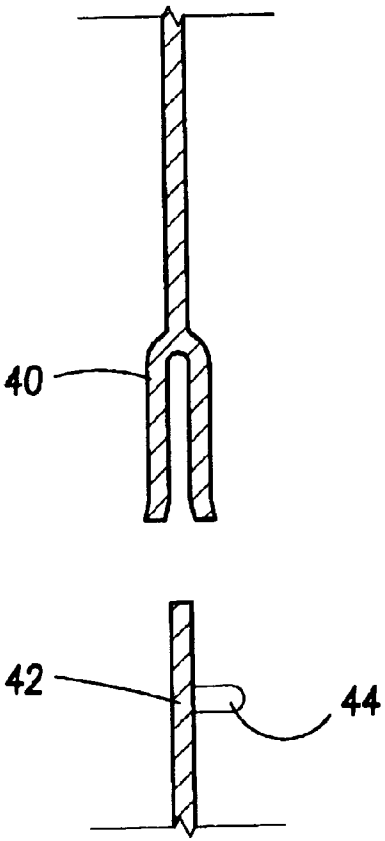
FIG. 3B is an enlarged exploded view of the joint between the upper and lower sections of the motor housing of FIG. 2.
Figure 3A:
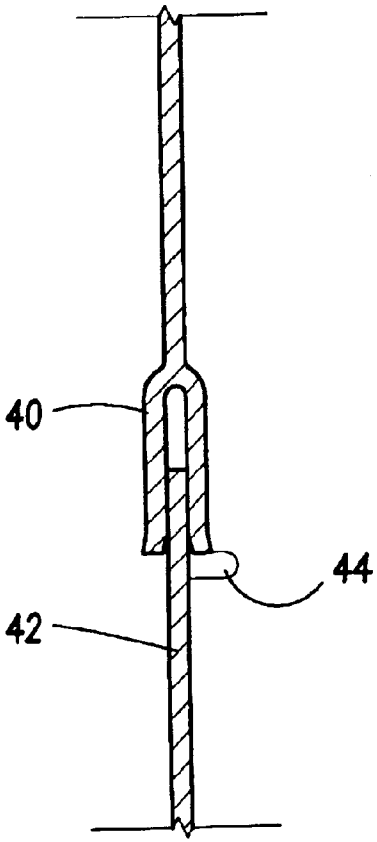
FIG. 3A is an enlarged view of the joint between the upper and lower sections of the motor housing of FIG. 2.

FIG. 3A shows an enlarged view of the joint between the upper section 16 and lower section 18 of the motor housing 14, while FIG. 3B is an exploded view of the same joint. Cooperating projections 40 at the free end of the side wall of the upper section 16 forms a y-shaped gap within which the outer edge 42 of the side wall of the lower section 18 may be inserted. Cooperating projections 40 are angled inward at the tips of the Y to provide guidance and ensure proper insertion of edge 42. The gap between the cooperating projections 40 is sized to correspond to the thickness of edge 42, in order to provide a snug friction fit between the pieces. It will be understood that the exact shape of the joint ends is not critical, as long as the edge fits snugly into the gap.

Preferably alignment pins such as protrusions 44 are spaced at intervals about the perimeter of the motor housing 14, as shown in FIG. 2. In the preferred embodiment, the alignment pins 44 are positioned on the outside surface of the edge 42 to provide guidance as to how far the two housing sections 16, 18 have to be pushed together to ensure a tight fit. The sections are pushed together until the outer one of the cooperating projections 40 abuts alignment pins 44. The alignment pins 44 also provide a visual guide, allowing visual inspection of the housing to ensure it is properly reassembled. Therefore the maximum distance the alignment pins 44 may be spaced from the edge 42 is equal to the depth of gap 40.

For simplicity, the description and drawings treat the gap 40 of the joint as extending downwardly from the upper section 16 of the housing 14, while the top rim of the lower section 18 forms the edge 42. This is preferred so that any grease draining down the interior of the motor housing does not drain into the gap. However, it will be understood that the joint directions may also be reversed.

Lower section 18 may include a drainage hole in the bottom (not shown). Preferably, lower section 18 has a wall 6 projecting into the chamber and defining an air inlet. When grease funnels to the bottom of the motor housing 14, wall 6 prevents it from draining through the inlet opening. Instead, the bottom surface of the motor housing is sloped so that the grease drains to the drainage hole and through a hose 58, where it collects in a grease cup 60. Grease cup 60 extends below range hood 10, where it is easily accessible and may be emptied without disassembling the entire range hood.

Tray 4 may be inserted in a gap formed between a downwardly extending projection 8 and wall 6. The tray acts to direct airflow into the fan and also acts to catch any grease that may drip off the outer circumference of the fan 30. This tray is releasably connectable to the motor housing allowing easy access to the fan.

In the alternative embodiment shown in FIG. 1A, no tray is present. Because the lower section 118 is removable for cleaning, it is unnecessary to attach a separate tray to the motor housing. Wall 106 depends from lower surface 104 forming an air inlet and acting as a barrier to grease collecting within the housing. Wall 108 in lower panel 36 forms an air inlet and when panel 36 is connected to the hood body 12 of the range hood 100, wall 108 and wall 106 are in abutment. Since no special fabrication is required to attach a tray to the lower section 118, lower section 118 may be a simpler piece, decreasing engineering and fabrication costs. However, not having a tray leads to a more involved process to access one of the fans as discussed further below. It is also contemplated that the lower section of the motor housing could be adapted to connect with the tray types of the prior art.

To fully stabilize the joint and provide extra sealing, a sealant such as silicon may be inserted into the gap 40 before the edge 42 is inserted. In order to access the interior of the motor housing and clean out any accumulated grease, it may be desirable to remove the lower section 18 of the motor housing 14. If the lower section 18 is to be removable, no sealant will be added to the joint prior to assembly of the upper and lower motor housing sections 16, 18.

Figure 4:
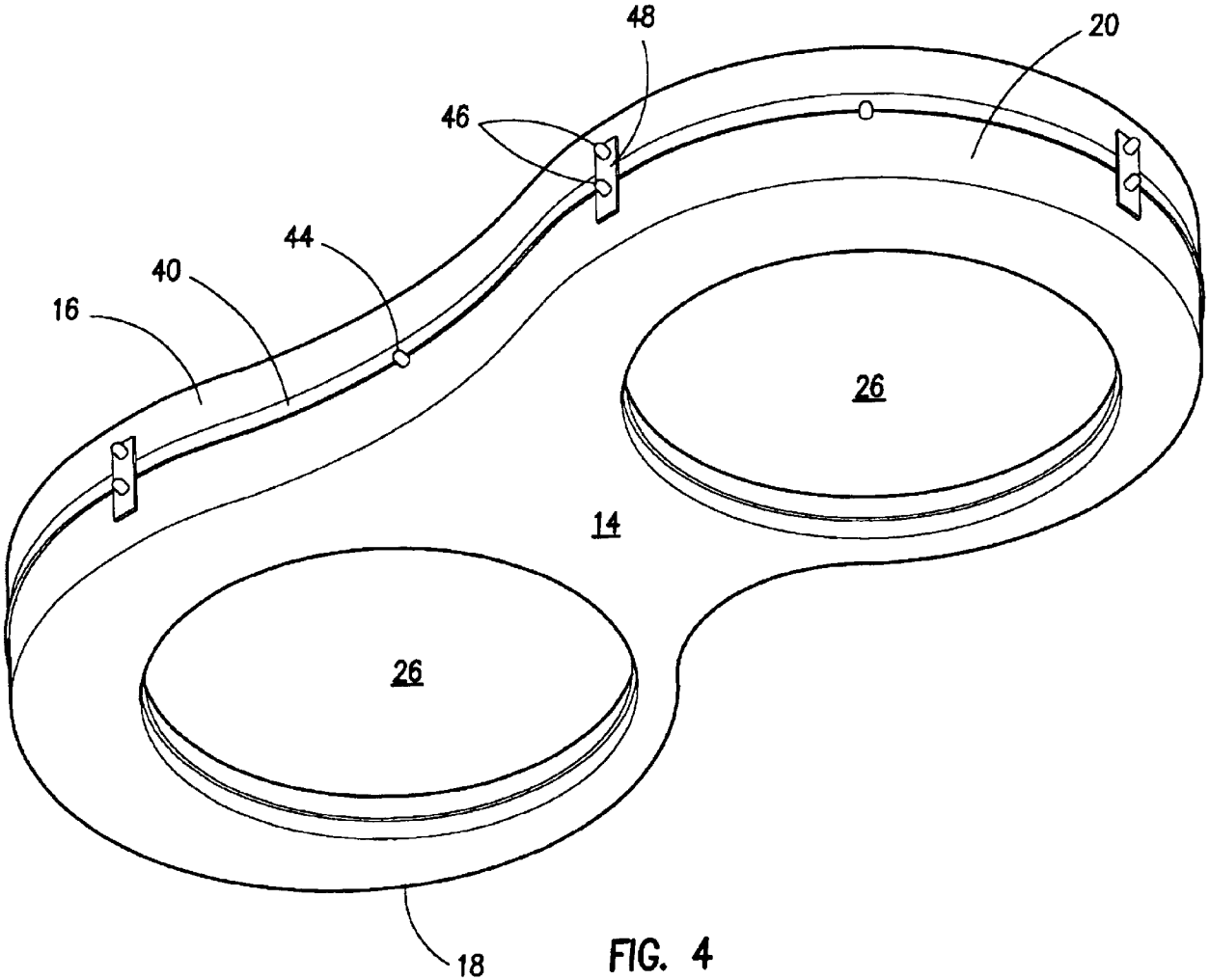
FIG. 4 is a bottom perspective view of an alternate embodiment of the motor housing.
Figure 5B:
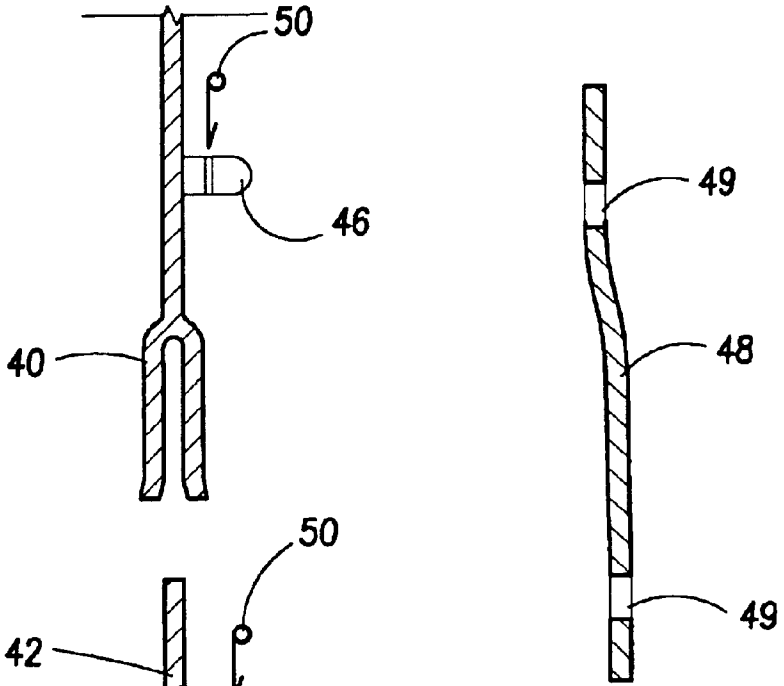
FIG. 5B is an enlarged exploded view of the joint between the upper and lower sections of the motor housing and the reinforcing assembly of FIG. 4.
Figure 5A:
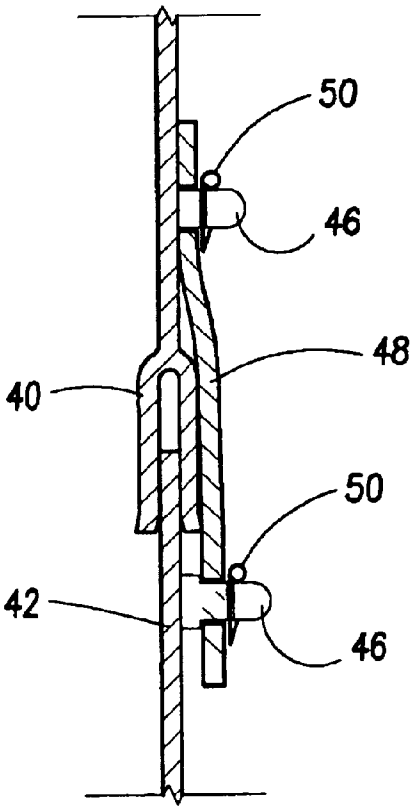
FIG. 5A is an enlarged view of the joint between the upper and lower sections of the motor housing and the reinforcing assembly of FIG. 4.

While the friction fit of the joint provides a firm connection of the two motor housing sections, it is also contemplated that further restraints may be incorporated to prevent unwanted separation of the two sections. Such a restraint is shown in an altemative embodiment of the invention is illustrated FIG. 4. The restraints provide extra support for the motor housing 14, to ensure that the upper and lower sections 16, 18 of the housing 14 stay firmly locked in place. Restraints such as reinforcing assemblies may therefore be placed at intervals around the perimeter of the housing 14, as shown in FIG. 4, and in greater detail in FIGS. 5–7.

Generally, a reinforcing assembly comprises a pair of reinforcing pins 46 integral to the outer surface of the upper and lower sections 16, 18 of motor housing 14, and a reinforcing strap 48 with holes 49. In the preferred embodiment of the invention, shown in FIGS. 5A and 5B, the holes 49 in the reinforcing strap 48 slide over the pins 46. The reinforcing strap 48 is then locked into place by insertion of cotter pins 50, or a similar locking mechanism such as a cable tie or twist tie, into grooves in reinforcing pins 46. It is contemplated that the reinforcing strap could be made of fabric, metal, plastic or any other suitable material that is heat resistant and non-stretching.

Figure 6B:
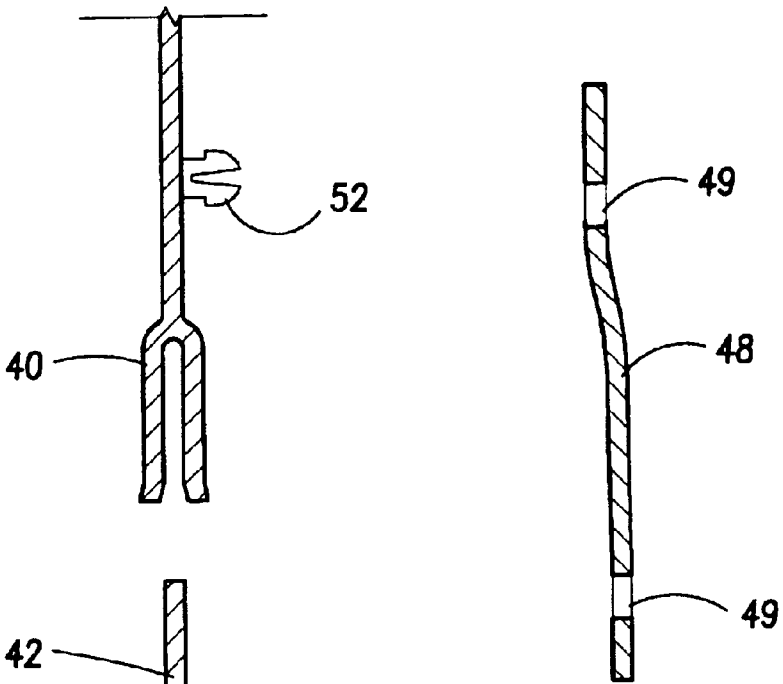
FIG. 6B is an enlarged exploded view of the joint between the upper and lower sections of the motor housing and an alternate embodiment of the reinforcing assembly of FIG. 4.
Figure 6A:
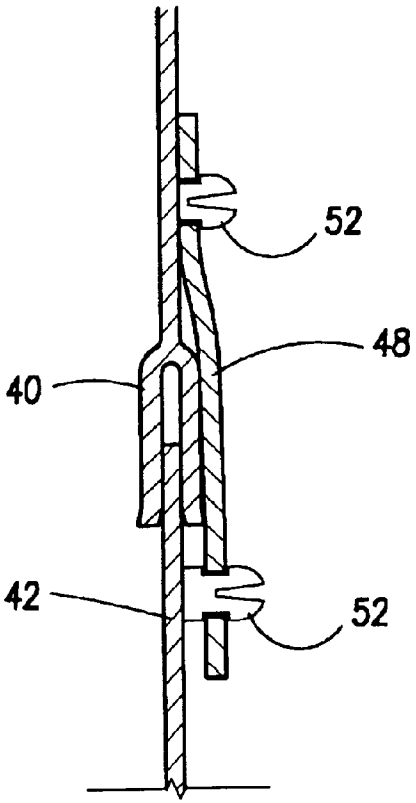
FIG. 6A is an enlarged view of the joint between the upper and lower sections of the motor housing and an alternate embodiment of the reinforcing assembly of FIG. 4.

In an alternate embodiment, shown in FIGS. 6A and 6B, reinforcing pins 46 may be replaced by self-locking snap-fit pins 52. The snap-fit pins 52 lock into place once reinforcing strap 48 is attached. Pressure must be exerted against the snap-fit pins in order to disconnect the strap 48.

Figure 7B:
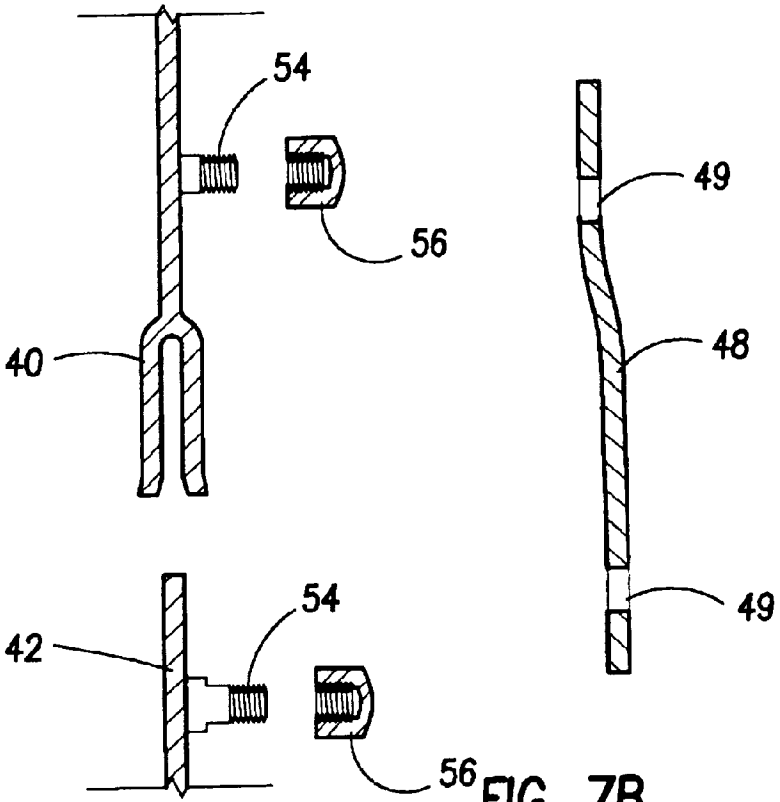
FIG. 7B is an enlarged exploded view of the joint between the upper and lower sections of the motor housing and a further alternate embodiment of the reinforcing assembly of FIG. 4.
Figure 7A:
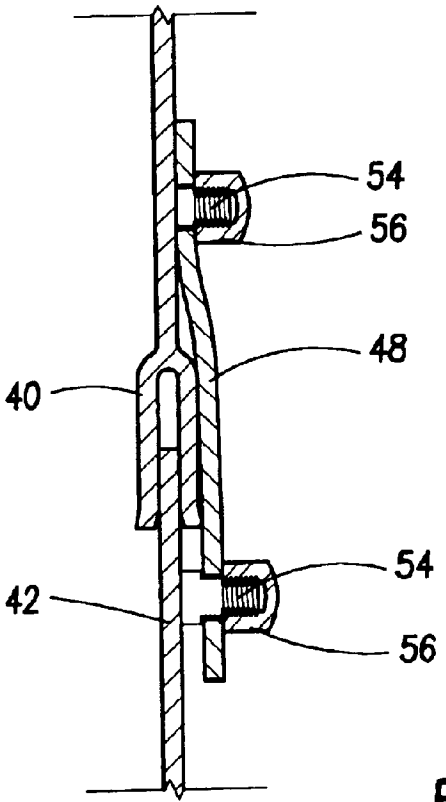
FIG. 7A is an enlarged view of the joint between the upper and lower sections of the motor housing and a further alternate embodiment of the reinforcing assembly of FIG. 4.

In a further alternate embodiment, shown in FIGS. 7A and 7B, bolts 54 may also be used to hold reinforcing strap 48 in place. Nuts 56 cover the exposed ends of the bolts 54, protecting users from injury and providing esthetic appeal.

In all embodiments, if the motor housing 14 is made of metal, the fastening means (fasteners such as pins 46, 52 or bolts 54) will preferably be welded onto the side of the upper and lower housing sections 16, 18. If the housing 14 is made of plastic, the fastening means will preferably be molded and integral to the housing sections 16, 18. Such fabrication will provide the strongest fastening means to reinforce the connection between upper section 16 and lower section 18.

To access the motor housing 14 for cleaning, it is necessary to remove lower panel 36. After disconnecting hose 58 lower section 18 may be pulled straight down in order to separate it from upper section 16, and out of the range hood 10. Lower section 18 may then be cleaned. The cleaning person also has direct access to the entire underside of upper section 16. The fan may also be easily removed to facilitate cleaning. The motor housing may be reassembled simply by lining up the edges of motor housing sections 16, 18 and pushing the two halves of the housing 14 together until the cooperating projections 40 meet alignment pins 44. It may also be advisable to complete a visual inspection, to ensure that the halves are completely and properly joined before reattaching the hose 58 and finally, lower panel 36.

Should access to only one fan be required, one need simply remove the lower panel 36 and tray 4. This may be preferable for minor cleaning of the motor housing interior.

If the motor housing is equipped with any of the reinforcing assemblies discussed above, these must be unfastened prior to pulling lower section 18 down to separate it from upper section 16 of the motor housing 14. To reassemble the motor housing 14, motor housing sections 16, 18 are first re-joined then the reinforcing assemblies are fastened. The reinforcing assemblies also provide a check to ensure the two sections 16, 18 are firmly in place, since reinforcing straps 48 will not fit over the pins unless the motor housing 14 has been reassembled properly.

It will be appreciated by those skilled in the art that the preferred and alternative embodiments have been described in some detail but that certain modifications may be practiced without departing from the principles of the invention.

What is claimed is:

1. A motor housing for mounting within a range hood body used to exhaust gases from above a cooking surface, said motor housing comprising:

an upper section having a top surface and a first side perimeter surface extending away from said top surface;

a lower section having a bottom surface and a second side perimeter surface extending away from said bottom surface;

the edge of one of said first or second side perimeter surfaces having cooperating projections with a gap therebetween; and, the edge of the other of said first or second side perimeter surfaces being adapted to be inserted in said gap between said cooperating projections to be frictionally retained therein and wherein said motor housing is mounted within said range hood.

2. The motor housing of claim 1 wherein said first side perimeter surface has said cooperating projections and the edge of said second side perimeter surface is adapted to be inserted in said gap between said cooperating projections to be frictionally retained therein.

3. The motor housing of claim 2 further comprising a plurality of protrusions on said second side perimeter surface.

4. The motor housing of claim 3 wherein said protrusions are spaced from said edge of said second side perimeter surface a maximum distance equal to the depth of said gap between said cooperating projections.

5. The motor housing of claim 1 further comprising a reinforcing assembly.

6. The motor housing of claim 5, wherein said reinforcing assembly comprises:

at least one reinforcing strap;

one fastening means for each reinforcing strap.

7. The motor housing of claim 6 wherein a plurality of said fastening means are spaced about the perimeter of said motor housing.

8. The motor housing of claim 6 wherein said fastening means comprises a pair of aligned fasteners, one fastener extending perpendicularly from said upper section and one fastener extending perpendicularly from said lower section.

9. The motor housing of claim 8 wherein said reinforcing strap comprises two holes, separated to allow one hole to mesh with each fastener.

10. The motor housing of claim 9 wherein each of said fasteners comprises a pin and cotter pin.

11. The motor housing of claim 9 wherein each of said fasteners comprises a self-locking pin.

12. The motor housing of claim 9 wherein each of said fasteners comprises a nut and a bolt.

* * * * *